US010597261B2

(12) United States Patent
González Pantiga et al.

(10) Patent No.: US 10,597,261 B2
(45) Date of Patent: Mar. 24, 2020

(54) TRANSPORT DEVICE

(71) Applicants: ThyssenKrupp Elevator Innovation Center S.A., Gijon (ES); thyssenkrupp AG, Essen (DE)

(72) Inventors: Juan Domingo González Pantiga, Gijón (ES); Elena González Ruibal, Oviedo (ES); Jonatan Hernández Álvarez, Oviedo (ES)

(73) Assignees: THYSSENKRUPP ELEVATOR INNOVATION CENTER S.A., Gijon (ES); THYSSENKRUPP AG, Essen (DE)

( * ) Notice: Subject to any disclaimer, the term of this patent is extended or adjusted under 35 U.S.C. 154(b) by 0 days.

(21) Appl. No.: 16/105,131

(22) Filed: Aug. 20, 2018

(65) Prior Publication Data

US 2019/0055110 A1 Feb. 21, 2019

(30) Foreign Application Priority Data

Aug. 21, 2017 (EP) ..... 17380018

(51) Int. Cl.
*B66B 29/04* (2006.01)
*B66B 31/02* (2006.01)
(Continued)

(52) U.S. Cl.
CPC ..... *B66B 29/04* (2013.01); *B66B 23/14* (2013.01); *B66B 23/22* (2013.01); *B66B 31/02* (2013.01)

(58) Field of Classification Search
CPC ..... B66B 29/04; B66B 23/14; B66B 23/22; B66B 31/02
(Continued)

(56) References Cited

U.S. PATENT DOCUMENTS 2,550,918 A * 5/1951 Otto ..... E04F 11/1836 198/338
3,941,241 A * 3/1976 Hishitani ..... B66B 31/02 198/494
(Continued)

FOREIGN PATENT DOCUMENTS

CN 205312855 U 6/2016
CN 206088722 U 4/2017
(Continued)

OTHER PUBLICATIONS

Extended European Search Report issued in EP17380018.6, dated May 9, 2018.

*Primary Examiner* — Mark A Deuble
(74) *Attorney, Agent, or Firm* — thyssenkrupp North America, Inc.

(57) ABSTRACT

A transport device for conveying passengers between first and second landing areas in a conveying direction may include a skirt member and a balustrade, which may include lower and upper sides, extending between the landing areas. The skirt member may be secured to the lower side. An endless moving handrail may form a loop. A first section of the handrail moves along the upper side of the balustrade in the conveying direction, and a second section of the handrail moves within the skirt member opposite the conveying direction. Two turnaround sections are disposed between the first and second sections near the first and second landing areas, respectively. At least one of the turnaround sections includes a cover member that renders part of the turnaround section of the handrail inaccessible to passengers. The cover member may comprise a positioning mechanism for adjustably positioning the cover member relative to the balustrade.

17 Claims, 3 Drawing Sheets

(51) Int. Cl.
*B66B 23/22* (2006.01)
*B66B 23/14* (2006.01)

(58) Field of Classification Search
USPC ..... 198/338
See application file for complete search history.

(56) References Cited

U.S. PATENT DOCUMENTS

| | | | | |
|---|---|---|---|---|
| 5,366,060 | A | 11/1994 | Johnson | |
| 7,854,313 | B1 | 12/2010 | Gotsche | |
| 10,160,622 | B2 * | 12/2018 | Kim | A61L 2/08 |
| 2005/0217971 | A1 * | 10/2005 | Kim | B66B 31/02 198/338 |
| 2007/0125476 | A1 * | 6/2007 | Kawasaki | B66B 31/02 156/94 |
| 2008/0185265 | A1 * | 8/2008 | Gonzalez Alemany | B66B 29/04 198/338 |
| 2009/0101470 | A1 | 4/2009 | Gonzalez Alemany | |

FOREIGN PATENT DOCUMENTS

| | | | | |
|---|---|---|---|---|
| EP | 0 648 704 | B | 6/1998 | |
| FR | 2368309 | A1 * | 5/1978 | B66B 31/02 |
| JP | S58192871 | U | 12/1983 | |
| WO | 2006099829 | A | 9/2006 | |
| WO | WO-2006099829 | A1 * | 9/2006 | B66B 23/22 |
| WO | WO-2016148389 | A1 * | 9/2016 | A61L 2/08 |

* cited by examiner

TRANSPORT DEVICE

CROSS-REFERENCE TO RELATED APPLICATION

This application is a non-provisional application claiming priority to European Patent Application No. EP 17380018.6, which was filed Aug. 21, 2017, the entire content of which is hereby incorporated by reference herein.

FIELD

The present disclosure generally relates to transport devices, including escalators and moving walkways.

BACKGROUND

An escalator is a moving staircase and typically involves a conveyor or transport device generally used for carrying people between floors of a building in a conveying direction. The device comprises a motor-driven chain of individual, linked steps that move up or down on tracks in the conveying direction, allowing the step treads to remain horizontal. Commonly, there is provided a balustrade on both sides of the escalator or moving walk, on which a handrail is provided, which also moves in conveying direction essentially at the same speed as the steps.

Escalators are used to move pedestrian traffic in places where elevators would be impractical. Principal areas of usage include locations such as department stores, malls, airports and other transit stations, train stations and public buildings.

Escalators have the capacity to move large numbers of people, and they can be placed in the same physical space as a staircase. They have no waiting interval (except during very heavy traffic). They can be used to guide people toward main exits or special exhibits. And they may be weatherproofed for outdoor use.

As a safety measure, escalators are required to have moving handrails that keep pace with the movement of the steps, as mentioned above. The handrail assists passengers to steady themselves, especially when stepping onto the moving steps.

However, handrails can also pose a danger for passengers. For example, in case a passenger positions himself on an entrance landing of an escalator, and inadvertently comes into contact with a handrail moving away from the entrance landing, i.e. in the conveying direction of the escalator, he can lose his balance, and might even fall over a balustrade. As a further example, in case a passenger enters an exit landing of an escalator, he might inadvertently contact a section of the handrail entering a newel end cap of the escalator, which may lead to injuries such as bruising or squashing of limbs.

Thus, a need exists to enhance the safety of transport devices such as escalators and moving walks. Accordingly, a need exists for transport devices such as escalators or moving walks that include a cover member. Likewise, a need exists for methods of retrofitting transport devices with such cover members.

DETAILED DESCRIPTION

Figure 1:
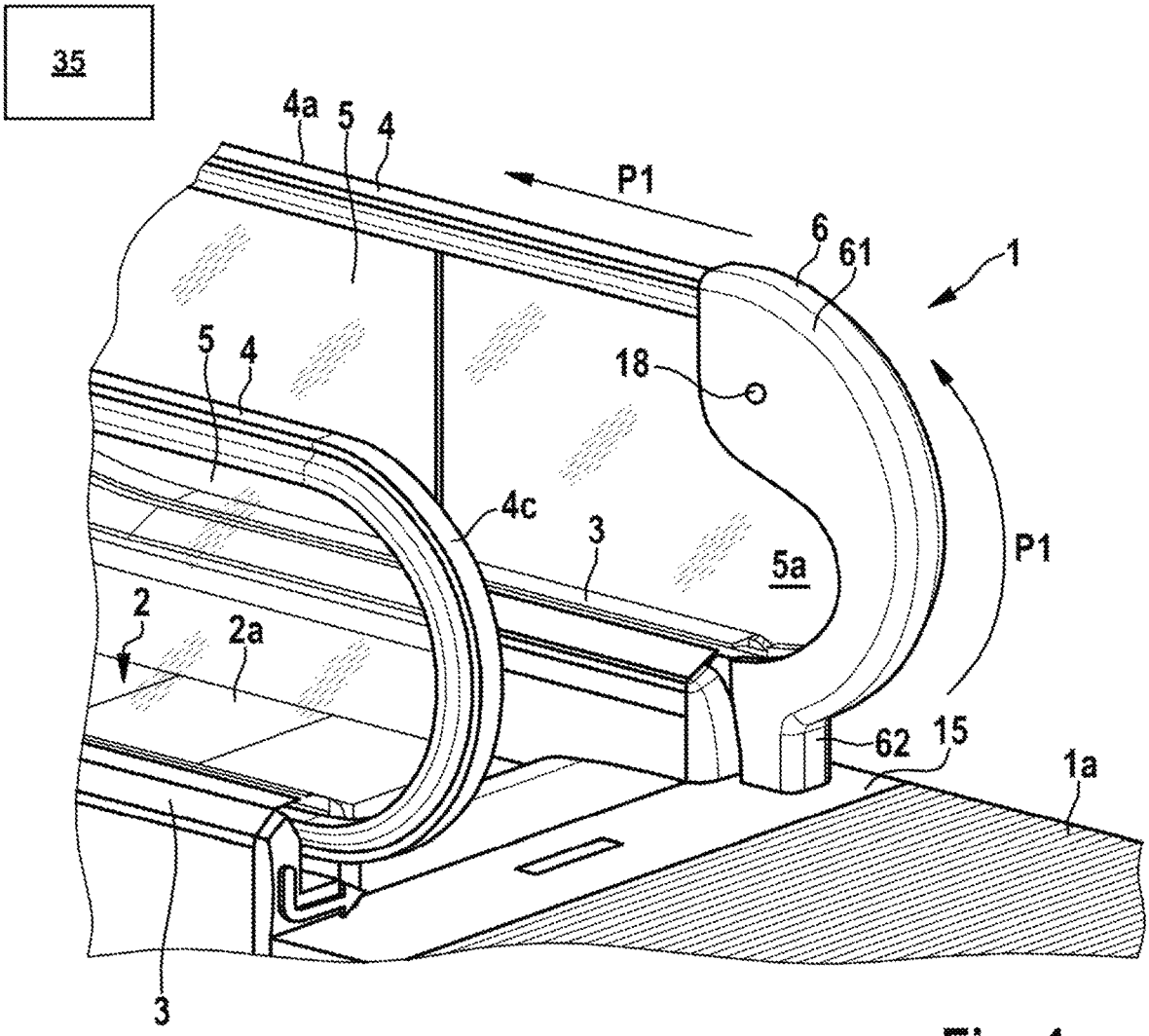
FIG. 1 is a perspective view of a first landing area of an example elevator.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

Moving walkways (or "moving walks") are similar to escalators in that they also involve conveyor or transport devices, albeit in a horizontal plane. The present disclosure is applicable to both escalators and moving walks. To simplify the description, however, only escalators will be referenced. Accordingly, those having ordinary skill in the art will understand that unless specified otherwise, the term "escalator" shall be deemed to encompass "moving walks."

In some examples, a transport device, such as an escalator or a moving walk for conveying passengers between a first landing area and a second landing area in a conveying direction, may include a skirt member and a balustrade. The balustrade may comprise a lower and an upper side. The skirt member and the balustrade may extend between the first landing area and the second landing area, with the skirt member being adapted to secure the balustrade by engagement with its lower side. The transport device may further comprise an endless moving handrail forming a loop, a first section of which moves along the upper side of the balustrade in conveying direction, and a second section of which moves within the skirt member in a direction opposed to the conveying direction. Two turnaround sections may be provided between the first and the second sections in the vicinity of the first landing area and of the second landing area respectively. At least one of the turnaround sections may be provided with a cover member adapted to render at least a part of the turnaround section of the handrail inaccessible to passengers. The cover member may comprise a positioning mechanism configured and adapted to position the cover member relative to the balustrade in an adjustable manner. The present disclosure provides a reliable and easy-to-handle safety feature for transport devices, by means of which the danger of inadvertently being drawn onto a transport device can be minimized. Furthermore, in some cases a horizontal distance between a balustrade and a side of the cover member, and/or a vertical distance between a handrail and an upper side of the cover member can be adjustably set.

The positioning mechanism may comprise at least one adjustable screw mechanism configured and adapted to adjust a distance and/or an orientation of the cover member relative to the balustrade. Such a screw mechanism is robust and easy to mount, whereby a desired distance between the balustrade (and thus the handrail) and the cover member can be easily set. Also, by means of such a screw mechanism, a set position can be easily maintained, providing enhanced stability for the cover member.

In some instances, the screw mechanism comprises a screw engaging a side wall of the cover member, an intermediate threaded or double threaded bushing and a support element engaging the balustrade, wherein the screw and the support element are adapted to threadingly engage the intermediate bushing such that the distance and/or orientation of cover member relative to balustrade can be adjustably set. Again, such a mechanism is characterized by its robustness and simple handling.

According to some examples, the positioning mechanism comprises a first screw mechanism interacting with a first side surface of the balustrade and a second screw mechanism interacting with a second side surface of the balustrade. Herewith, a cover member essentially straddling the balustrade, thus offering protection from both sides, can be positioned in a simple and reliable way, and also reliably be maintained in this set position.

The cover member may extend between a newel end cap of the balustrade and a point essentially vertically above a starting point of moving steps of the transport device. The newel end cap is defined as the part of the skirt member where the handrail enters (or exits) the skirt member. By providing the cover member over this length of the turnaround section, it can be effectively ensured that only when a passenger steps on the moving steps will he be able to touch or grasp a moving handrail. Situations, in which he is not yet walked on to the steps, but can come into contact with or grasp a moving handrail, which might lead to a passenger losing his balance, can be avoided.

According to some examples, the cover member is fixedly attached to the skirt member, especially the newel end cap, and/or a landing cover plate of the transport device. It is emphasized that this feature can be provided independently of the feature of providing the cover member with a positioning mechanism. Thus, the cover member could be fixedly attached to a skirt member and/or landing cover without additionally positioning it by means of a positioning mechanism. However, in some cases, the cover member is fixedly attached to a skirt member and/or a landing cover and, at the same time, positioned relative to a balustrade using an adjustable positioning device. This provides enhanced stability for the cover member.

The cover member may be made of a plastics or polycarbonate material, which may be reinforced with fibers. Such materials are robust and can be provided in an aesthetically pleasing manner.

The transport device may further comprise an anti-entrapment safety device adapted to cooperate with the cover member. Such a device serves to prevent a passenger inserting his hand between the handrail and the cover member. It can, for example, be provided in form of a mesh or other features extending vertically downward from an end of the cover element in the direction of the handrail.

The transport device may further comprise a deactivation system adapted to deactivate the transport device in case a passenger enters it in a direction opposed to transportation direction. Hereby, especially accidents due to entrapment of for example a hand or an arm of a passenger between the handrail and the cover member due to inappropriate use of an escalator can be avoided.

According to the disclosure there is also disclosed a cover member for a handrail of a transport device, especially of an escalator or a moving walk, comprising a positioning mechanism configured and adapted to position the cover member relative to a balustrade of the transport device in an adjustable manner. Advantages attributable to such a configuration have been discussed above.

In some example cover members, the positioning mechanism comprises at least one adjustable screw mechanism configured and adapted to adjust a distance and/or an orientation of the cover member relative to the balustrade. Again, the advantages of such a mechanism are discussed above.

The screw mechanism may comprise a screw engaging a side wall of the cover member, an intermediate threaded or double threaded bushing and a support element engaging the balustrade, wherein the screw and the support element are adapted to threadingly engage the intermediate bushing such that the distance and/or orientation of cover member relative to balustrade can be set.

According to some examples, the positioning mechanism comprises a first screw mechanism engaging a first side surface of the balustrade and a second screw mechanism engaging a second side surface of the balustrade.

The present disclosure also concerns methods for retro- or backfitting a transport device, especially an escalator or moving walk, with a cover member for a handrail, comprising the following steps: providing a cover member according to the disclosure, especially according to one of the examples, over a handrail provided on a balustrade of the transport device, adjusting the position of the cover member by means of a positioning mechanism relative to the balustrade such that the cover member has a desired position comprising desired distance and/or orientation relative to the balustrade, and fixing the cover member in the desired position. With this example method, existing transport devices can be effectively backfitted to enhance safety.

This example method comprises fixedly attaching the cover member to a skirt member and/or a landing cover plate of the transport device. This can be done before or after fixing the cover member in its desired position by means of the positioning mechanism.

It is also possible to fixedly attach the cover member to a skirt member and/or a landing cover plate without also fixing it in its desired position by means of the positioning mechanism. The cover member according to the disclosure is of a simple design that can be installed over an existing handrail on any escalator. As outlined above, it serves two purposes in particular: preventing passengers, for example children, from accidentally contacting the handrail in the newel sections, and also providing a stationary hand guide, for example for elderly passengers, to gain footing when approaching the moving steps of an escalator.

With reference now to the figures, FIG. 1 shows a perspective view of a first landing area 1*a* of an example escalator 1. The arrows P1 depict the conveying direction of the escalator 1 so that the landing area 1*a* shown is an entrance area.

Figure 3:
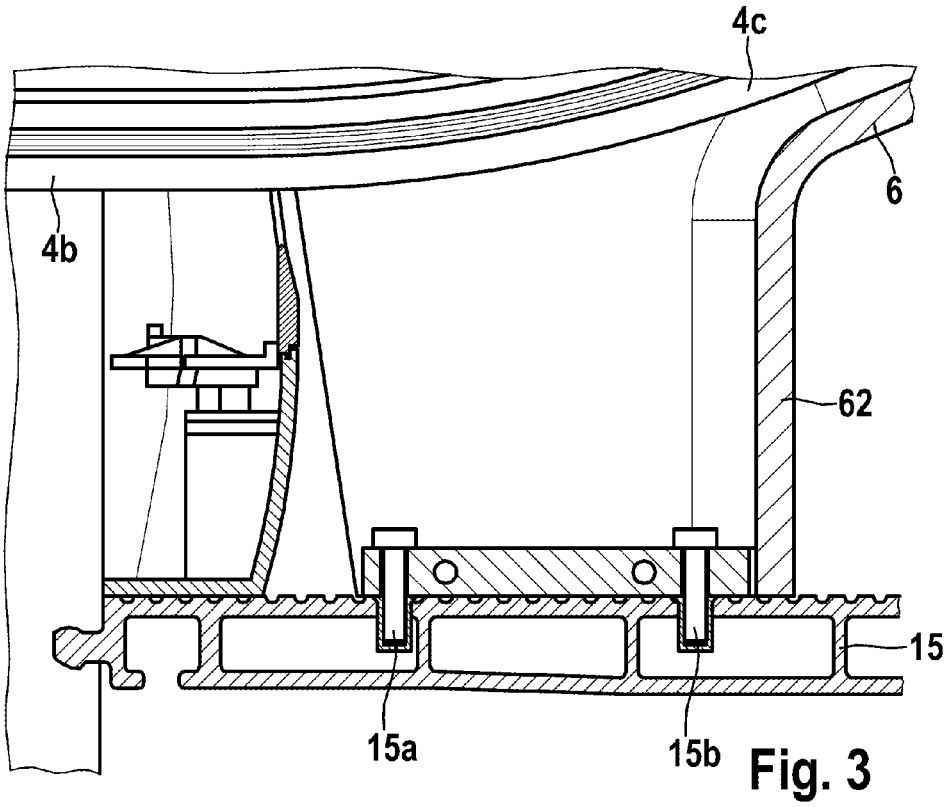
FIG. 3 is an enlarged cross-sectional view of an attachment of the example cover member of FIG. 1 to an example landing cover plate.

The example escalator 1 comprises two endless moving handrails 4, a stairway 2, comprising steps 2*a* and a skirt 3, for each handrail 4. For purposes of easy reference, handrails 4, which each form an endless loop, are described as being respectively provided with a first section 4*a* which is accessible to passengers, and travels in the conveying direction of the elevator, and a second section, which is inaccessible to passengers and travels in a direction opposed to the conveying direction. Part of this second section is shown in FIG. 3 and designated 4*b*. This second section travels within skirt 3, which extends over the whole length of the escalator between the two landing areas. Between the first and the second sections, at each landing area of the elevator, a turnaround section 4*c* is provided for each handrail. Only one such turnaround section 4*c* per handrail is visible in FIG. 1. Obviously, further turnaround sections (not shown) are provided at the opposing landing area of the escalator 1. Typical escalator features such as a comb in the transition area between landing area and steps are not explicitly shown in the figures.

Figure 2:
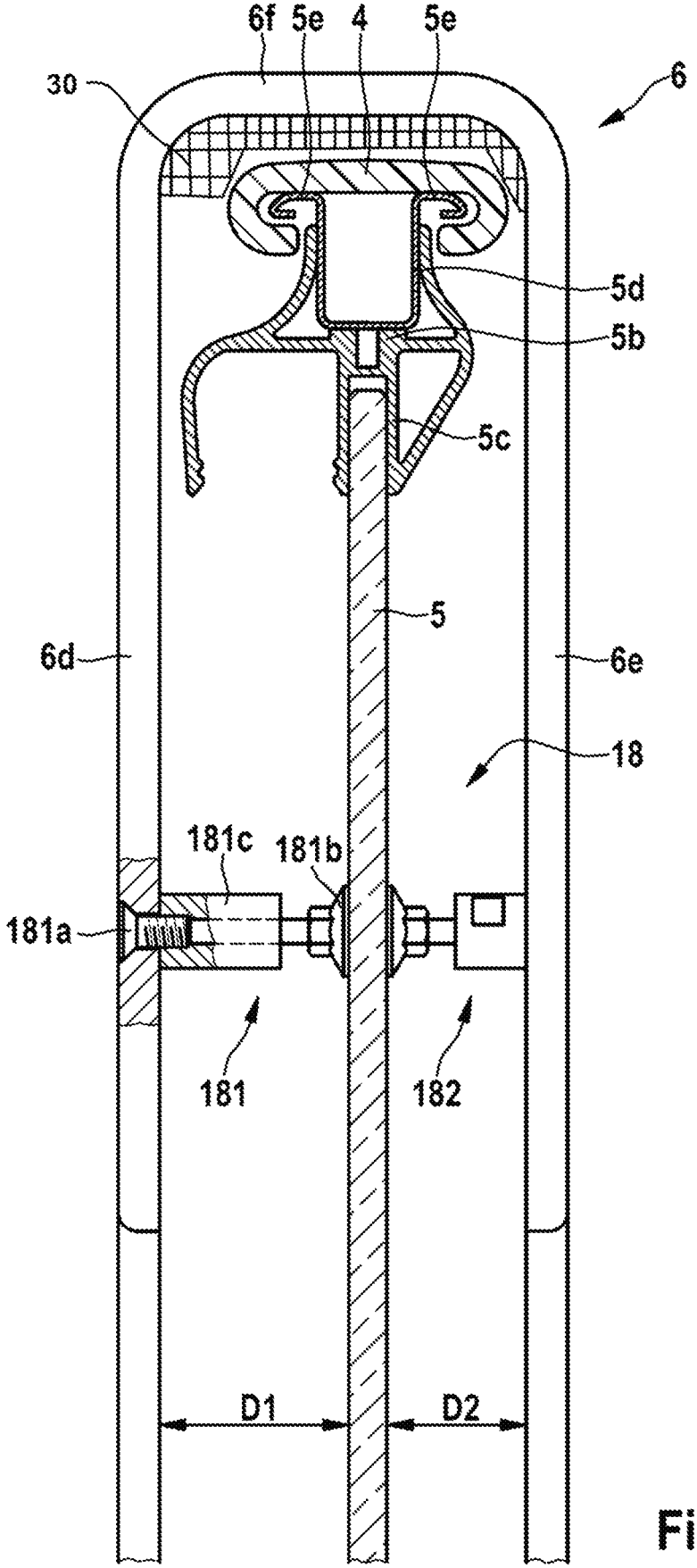
FIG. 2 is a sectional view through an example cover member and corresponding section of an example handrail according to FIG. 1.

The skirts 3 are respectively adapted to hold a balustrade 5 at their respective lower sides. The balustrades 5 also extend along the whole length of the escalator. The rounded end sections of balustrade 5 are referred to a newel, designated 5*a* in the figures. Balustrades 5 serve to guide the handrails 4 in first section 4*a*. As can be seen in FIG. 1 and FIG. 2, the handrail is adapted to move along the upper sides of respective balustrades 5. In order to provide such a movement of the handrail 4 along the balustrade 5 in a safe manner with low friction, the upper side of the balustrade 5 is provided with a holding mechanism 5*b*, which, in one example, straddles the upper side of the balustrade 5 with its lower and 5*c*, and comprises an upper member 5*d* defining a gliding surface 5*e* for handrail 4.

As can be seen in FIG. 1 and FIG. 2, an example cover member 6 is provided, which covers or straddles handrail 4 in turnaround section 4*c*. Cover member 6 comprises a first side wall 6*d*, a second side wall 6*e* and a top section 6*f* connecting the two side walls. Be it noted that in FIG. 1 only one handrail 4 is shown with such a cover member 6. In practice, usually both handrails 4 will be provided with such a cover member 6. However, it is also possible to provide only one handrail 4 with such a cover member 6, for example if dangers or hazards are only present on one side of the escalator.

Cover member 6 comprises a cover section 61 which essentially follows the curvature of handrail 4 in the turnaround section 4*c*. It is also provided with an attachment section 62, at which it is fixedly attached to static components of the escalator, as will be described in the following. The escalator 1 may further comprise an anti-entrapment safety device adapted to cooperate with the cover member 6. Such a device may serve to prevent a passenger from inserting his hand between the handrail 4 and the cover member 6. It can, for example, be provided in the form of a mesh 30 or other features extending vertically downward from an end of the cover member 6 in the direction of the handrail 4. Still further, the escalator 1 may comprise a deactivation system 35 adapted to deactivate the escalator 1 in case a passenger enters it in a direction opposed to transportation direction. Hereby, especially accidents due to entrapment of for example a hand or an arm of a passenger between the handrail 4 and the cover member 6 due to inappropriate use of the escalator 1 can be avoided.

Attachment section 62, which may be integrally formed with the cover section 61, can be attached to a landing cover plate 15, as especially shown in FIG. 3. In FIG. 3, the attachment section 62 of cover member 6 is shown in more detail. Also, part of the second section 4*b* and of turnaround section 4*c* of handrail 4 is shown. Here, the attachment section 62 is fixedly connected to a landing cover plate 15 of the escalator. For fixation, a number of bolts or screws 15*a*, 15*b*, interacting with corresponding threaded holes in attachment section 62 and landing cover plate 15 are utilized.

As can be seen from FIGS. 1 and 2, cover member 6 is provided with a positioning mechanism 18, which provide stabilization of cover member 6 relative to balustrade 5 by engaging side walls 6*d* and 6*e*. Furthermore, the positioning mechanism 18 is provided such that respective distances D1, D2 between the side walls 6*d*, 6*e* of cover member 6 and the balustrade 5 can be adjusted and secured in the set position. The positioning mechanism 18 comprises a first screw mechanism 181, provided between side wall 6*d* and balustrade 5, and a second screw mechanism 182 between side wall 6*e* and balustrade 5. For ease of reference, the individual components of the screw mechanism will only be described for first screw mechanism 181 in the following. Each screw mechanism comprises a screw 181*a*, comprising a threading, extending through a hole in side wall 6*d*, 6*e*, i.e., engaging the side wall 6*d*, 6*e*, and also a support element 181*b* engaging the balustrade 5. Support element 181*b* comprises a threading on its circumference. Between there is provided an intermediate bushing 181*c* adapted to be threadingly engaged by screw 181*a* and support element 181*b*. By turning screw 181*a* and/or support element 181*b* relative to bushing 181*c*, the distance between side wall 6*d*, 6*e* and balustrade 5 can be adjusted and set.

Figure 4:
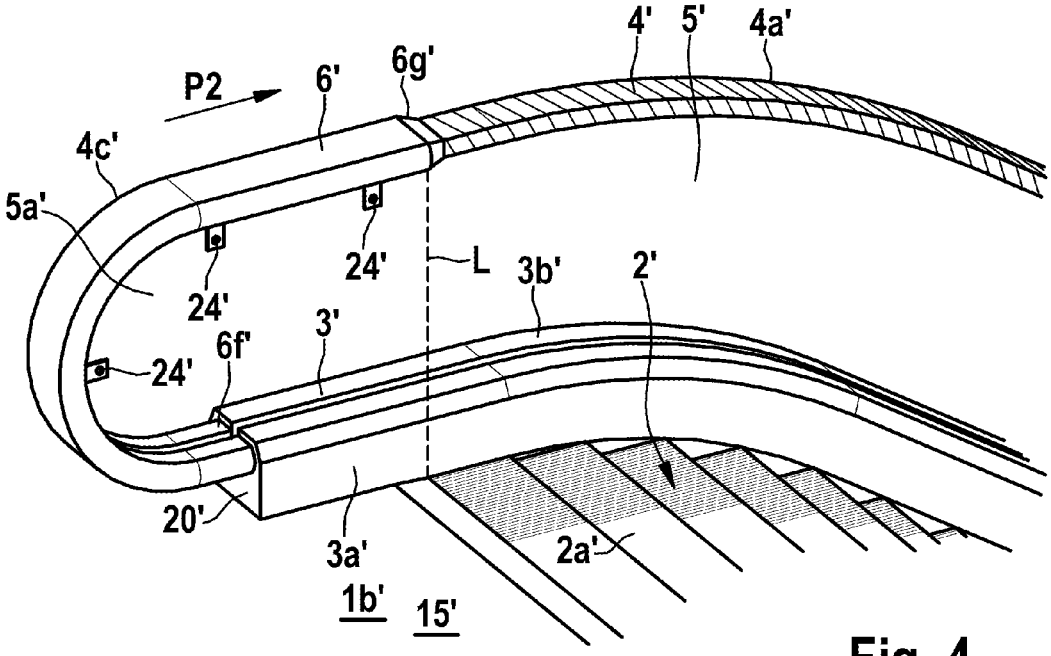
Fig. 4 (PRIOR ART)
FIG. 4 is a perspective view of an elevator comprising a prior art cover element.

Reference is now made to FIG. 4. Although FIG. 4 shows an escalator according to the prior art, one advantageous feature, which is also applicable to the transport device according to the present disclosure shall now be briefly explained with reference to FIG. 4.

FIG. 4 shows a cover member 6' of an escalator according to the prior art. Here, an upper landing area 1*b'* is shown, from which the conveying direction of the elevator is downward towards a lower landing (not shown in FIG. 4), as indicated by the arrow P2. Corresponding components of the escalator are designated with the same reference numerals as in the previous figures (with hyphens added), so that a description of these components and their functions will be omitted.

The main difference between this prior art elevator and the example shown in the previous figures lies in the attachment of cover element 6 relative to static components of the escalator. According to this prior art escalator, the lower end 6*f'* of cover member 6' is attached to a newel end cap 20', which forms the end cap of and is attached to skirt member 3'. It could additionally or alternatively be attached to a side panel 3*a'* or a top panel 3*b'* of skirt 3'.

Furthermore, along its extension between said lower end 6*f'* and an upper end 6*g'*, i.e., in turnaround section 4*c'*, the cover member is attached to balustrade 5' by means of a number of brackets 24'. Such brackets as used in the prior art require the provision of holes in the balustrade, which interact with screws or bolts for securing the brackets and thus the cover member to the balustrade. Especially retrofitting an escalator with such a cover member is cumbersome and requires a substantial amount of skilled work, including providing bore holes in the balustrade. As positioning a cover member relative to a balustrade only requires setting the adjustment mechanism without in any way damaging the balustrade, such retrofitting work is significantly reduced.

According to the example shown in FIG. 4, the upper end 6*g'* of cover member 6' is positioned essentially or exactly vertically above the position at which moving steps 2*a'* of stairway 2' emerge from under cover plate member 15', for example in a comb area (not specifically shown), as indicted by dashed line L. This dimensioning of cover member 6' especially ensures that a passenger approaching the escalator 4 can position himself on cover plate member 15' (which does not move), and at the same time stabilize himself by grasping cover member 6', which is also static. By simultaneously stepping on a step 2*a*' and grasping handrail 4', a safe transition from the static landing to the moveable steps of the escalator can be accomplished. As mentioned, this dimensioning of the cover member may also be applicable for the example of the disclosure shown in FIGS. 1 to 3.

Be it noted that the components for fixedly attaching the cover member 6 to static components of the escalator as described in connection with the first example of FIGS. 1 to 3 and of the prior art escalator of FIG. 4 may also be combined, at least in part.

What is claimed is:

1. A transport device for conveying passengers in a conveying direction between a first landing area and a second landing area, the transport device comprising:

a balustrade including a lower side and an upper side;

a skirt member, wherein the skirt member and the balustrade extend between the first landing area and the second landing area, the skirt member adapted to secure the balustrade by engagement with the lower side of the balustrade;

an endless moving handrail that forms a loop, wherein a first section of the endless moving handrail is configured to move along the upper side of the balustrade in the conveying direction, wherein a second section of the endless moving handrail is configured to move within the skirt member in a direction opposite the conveying direction, wherein first and second turnaround sections are disposed between the first and second sections of the endless moving handrail, the first turnaround section disposed proximate the first landing area and the second turnaround section disposed proximate the second landing area; and a cover member disposed at at least one of the turnaround sections, the cover member being adapted to render at least part of the at least one of the turnaround sections of the endless moving handrail inaccessible to passengers, wherein the cover member comprises;

a cover section that follows a curvature of the at least one of the turnaround sections of the endless moving handrail;

an attachment section that is configured to be fixedly attached to at least one of the skirt member or a landing cover plate; and a positioning mechanism configured to position the cover section relative to the balustrade in an adjustable manner.

2. The transport device of claim 1 wherein the positioning mechanism comprises an adjustable screw mechanism configured to adjust at least one of a distance or an orientation of the cover section relative to the balustrade.

3. The transport device of claim 2 wherein the adjustable screw mechanism comprises a screw that engages a side wall of the cover section, an intermediate threaded bushing or a double threaded bushing, and a support element engaging the balustrade, wherein the screw and the support element are adapted to threadingly engage the intermediate threaded bushing or a double threaded bushing such that the at least one of the distance or the orientation of the cover section relative to the balustrade can be adjustably set.

4. The transport device of claim 1 wherein the positioning mechanism comprises:

a first screw mechanism configured to interact with a first side surface of the balustrade; and a second screw mechanism configured to interact with a second side surface of the balustrade.

5. The transport device of claim 1 wherein the cover member extends between a newel end cap of the balustrade and a point vertically above a starting point of moving steps of the transport device.

6. The transport device of claim 1 wherein the cover section is fixedly attached to the landing cover plate.

7. The transport device of claim 1 wherein the cover member is comprised of a fiber-reinforced plastic or a fiber-reinforced polycarbonate material.

8. The transport device of claim 1 comprising an anti-entrapment safety device adapted to cooperate with the cover member.

9. The transport device of claim 1 comprising a deactivation system adapted to deactivate the transport device in a case where a passenger enters the transport system in a direction opposite the conveying direction.

10. The transport device of claim 1 wherein the attachment section is fixedly attached to the skirt member.

11. A cover member for a handrail of a transport device, the cover member comprising a cover section that follows a curvature of a turnaround section of the handrail;

an attachment section that is configured to be fixedly attached to at least one of a skirt member or a landing cover plate of the transport device; and a positioning mechanism configured to position the cover section relative to a balustrade of the transport device in an adjustable manner.

12. The cover member of claim 11 wherein the positioning mechanism comprises an adjustable screw mechanism configured to adjust at least one of a distance or an orientation of the cover section relative to the balustrade.

13. The cover member of claim 12 wherein the adjustable screw mechanism comprises a screw engaging a side wall of the cover section, an intermediate threaded bushing or a double threaded bushing, and a support element engaging the balustrade, wherein the adjustable screw mechanism and the support element are adapted to threadingly engage the intermediate threaded bushing or the double threaded bushing such that the at least one of the distance or the orientation of the cover section relative to the balustrade can be set.

14. The cover member of claim 11 wherein the positioning mechanism comprises:

a first screw mechanism configured to engage a first side surface of the balustrade; and a second screw mechanism configured to engage a second side surface of the balustrade.

15. The cover member of claim 11 wherein the attachment section is fixedly attached to the landing cover plate.

16. A method for retrofitting a transport device with a cover member for a handrail of a transport device, the method comprising:

providing the cover member over the handrail, wherein the cover member comprises a positioning mechanism configured to position a cover section of the cover member relative to a balustrade of the transport device in an adjustable manner;

fixedly attaching an attachment section of the cover member to a skirt member or a landing cover plate of the transport device; and adjusting a position of the cover section relative to the balustrade with the positioning mechanism such that the cover section is positioned at least one of a predetermined distance or a predetermined orientation relative to the balustrade.

17. The method of claim 16 comprising fixedly attaching the attachment section to the landing cover plate.

* * * * *